US007475662B2

(12) United States Patent
Suzuki et al.

(10) Patent No.: US 7,475,662 B2
(45) Date of Patent: Jan. 13, 2009

(54) ACTUATOR FOR VALVE LIFT CONTROLLER

(75) Inventors: Yasuyoshi Suzuki, Chiryu (JP); Hideo Inaba, Okazaki (JP); Jouji Yamaguchi, Chiryu (JP); Toshiki Fujiyoshi, Okazaki (JP); Akira Tsunoda, Toyohashi (JP); Koichi Shimizu, Toyota (JP)

(73) Assignees: Denso Corporation (JP); Toyota Jidosha Kabushiki Kaisha (JP)

( * ) Notice: Subject to any disclaimer, the term of this patent is extended or adjusted under 35 U.S.C. 154(b) by 296 days.

(21) Appl. No.: 11/411,152

(22) Filed: Apr. 26, 2006

(65) Prior Publication Data

US 2006/0245098 A1 Nov. 2, 2006

(30) Foreign Application Priority Data

Apr. 28, 2005 (JP) ..... 2005-132477

(51) Int. Cl.
*F01L 1/34* (2006.01)

(52) U.S. Cl. ..... 123/90.18; 123/90.11; 123/90.15; 123/90.16

(58) Field of Classification Search ..... 123/90.18
See application file for complete search history.

(56) References Cited

U.S. PATENT DOCUMENTS

| | | | | | |
|---|---|---|---|---|---|
| 4,561,390 | A | * | 12/1985 | Nakamura et al. | 123/90.15 |
| 5,381,764 | A | * | 1/1995 | Fukuma et al. | 123/90.17 |
| 6,129,061 | A | * | 10/2000 | Okuda et al. | 123/90.17 |
| 6,425,357 | B2 | | 7/2002 | Shimizu et al. | |
| 2004/0083997 | A1 | | 5/2004 | Shibata et al. | |

* cited by examiner

*Primary Examiner*—Thomas E Denion
*Assistant Examiner*—Kyle M Riddle
(74) *Attorney, Agent, or Firm*—Nixon & Vanderhye PC

(57) ABSTRACT

A feed screw mechanism including a screwed shaft which moves linearly along with the control shaft, and a rotation spindle which rotates in a circumferential direction. The feed screw mechanism converts a rotational movement of the rotation spindle into a linear movement of the screwed shaft. A protrusion protrudes outwardly from the rotation spindle. An internal thread member engages with an outer wall surface of the rotation spindle. A motor stator generating a magnetic is positioned over the rotation spindle, and is sandwiched between the protrusion and the internal thread member in an axial direction of the rotation spindle.

11 Claims, 7 Drawing Sheets

ACTUATOR FOR VALVE LIFT CONTROLLER

CROSS REFERENCE TO RELATED APPLICATION

This application is based on Japanese patent application No. 2005-132477 filed on Apr. 28, 2005, the disclosure of which is incorporated herein by reference.

FIELD OF THE INVENTION

The present invention relates to an actuator for valve lift controller controlling a lift amount of an intake valve and/or an exhaust valve of an internal combustion engine (hereafter referred to simply as an engine).

BACKGROUND OF THE INVENTION

In conventional valve lift controllers, several types of actuators are used to linearly drive a shaft of a changing mechanism which controls a lift amount of a valve based on a position of the shaft in its axial direction. For example, an actuator is described in US-2004-0083997A1 (JP-2004-150332A) which converts, by means of a reduction mechanism and a cam mechanism, a rotational driving force of a motor unit into a linear driving force and applies the linear driving force to the shaft of the changing mechanism.

However, the conventional actuator has to use the reduction mechanism in combination with the cam mechanism to make the linear driving force larger. It is therefore difficult to design the actuator to be small. Thus, positions where the actuator can be installed are limited.

The inventors of the present invention have studied a structure of a feed screw mechanism which converts a rotational movement of a rotation spindle to a linear movement of a screwed shaft. The feed screw mechanism can generate a strong linear driving force by means of a simple structure in which the rotation spindle and the screwed shaft are coaxially connected directly or indirectly. An actuator with the feed screw mechanism therefore can be designed to be smaller than the actuator with the reduction mechanism and the cam mechanism.

In the case that a motor rotor is press-fixed on the rotation spindle, the rotation spindle may be deformed, so that a faulty operation of the feed screw mechanism may arise.

SUMMARY OF THE INVENTION

It is therefore an object of the present invention to provide an actuator for a valve lift controller which can be operated without any faulty.

According to the actuator of the present invention, a feed screw mechanism including a screwed shaft which moves linearly along with the control shaft, and a rotation spindle which rotates in a circumferential direction. The feed screw mechanism converts a rotational movement of the rotation spindle into a linear movement of the screwed shaft. A protrusion protrudes outwardly from the rotation spindle. An internal thread member engages with an outer wall surface of the rotation spindle. A motor stator generating a magnetic is positioned over the rotation spindle, and is sandwiched between the protrusion and the internal thread member in an axial direction of the rotation spindle. Hence, the motor rotor is easily fixed on the rotation spindle in the axial direction without deforming the rotation spindle.

BRIEF DESCRIPTION OF THE DRAWINGS

The invention, together with additional objective, features and advantages thereof, will be best understood from the following description, the appended claims and the accompanying drawings. In the drawings:

DETAILED DESCRIPTION OF THE EMBODIMENTS

First Embodiment

Figure 2A:
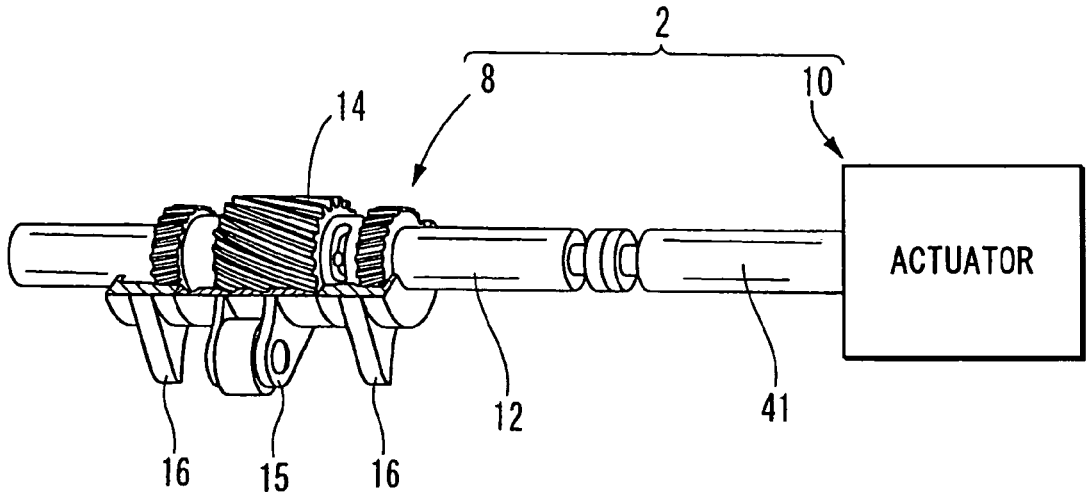
FIG. 2A is a partially cross-sectional view showing the valve lift controller.
Figure 2B:
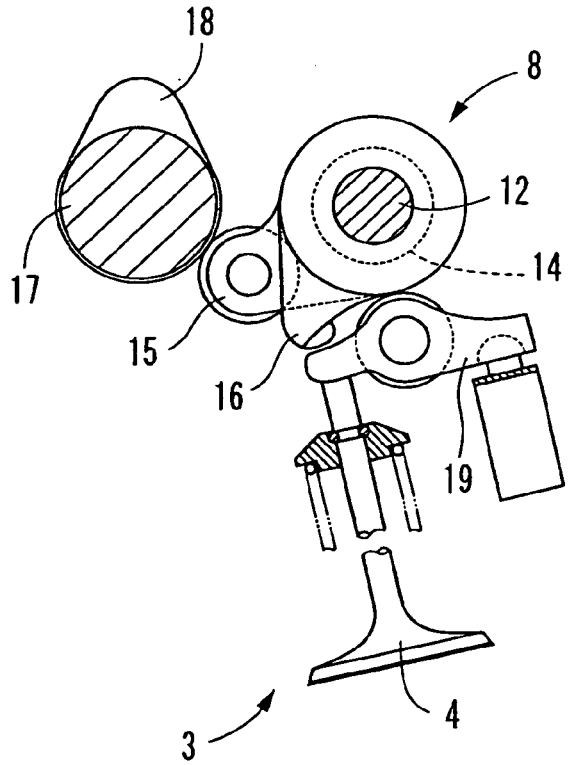
FIG. 2B is a cross-sectional view showing the valve lift controller.

As shown in FIGS. 2A and 2B, a valve lift controller 2 includes a changing mechanism 8 and an actuator 10, and controls an amount of a lift of an intake valve 4 of an engine 3.

The changing mechanism 8, which is disclosed in for example JP 2001-263015A, is mounted on the engine 3 and includes a control shaft 12, a slide gear 14, an input unit 15, and swinging cams 16. The slide gear 14 is linearly movable along with the control shaft 12 in the axial direction of the control shaft 12 and is engaged with a helical spline on inner surfaces of the input unit 15 and the swinging cams 16. A difference between rotational phases of the input unit 15 and the swinging cams 16 around the axial direction changes according to a position of the control shaft 12 in the axial direction.

The input unit 15 is in contact with an intake cam 18 of a camshaft 17, and one of the swinging cams 16 can be in contact with a rocker arm 19 of the intake valve 4. A swing angle range, which is a range of angle around the axial direction within which the swinging cam 16 can move, varies depending on the difference between the rotational phases of the input unit 15 and the swinging cams 16. Therefore, the changing mechanism 8 controls a valve lift amount, which is an amount of an upward movement of the intake valve 6, depending on the position of the control shaft 12 in the axial direction, and thereby controls characteristics of the intake valve 6 such as a valve acting angle or the maximum valve lift amount. In the embodiment, a valve resistance force, which is a force applied by the intake valve 6 to the control shaft 12, serves as a thrust force applied in a direction opposite to a direction from the control shaft 12 to the actuator 10.

Figure 3:
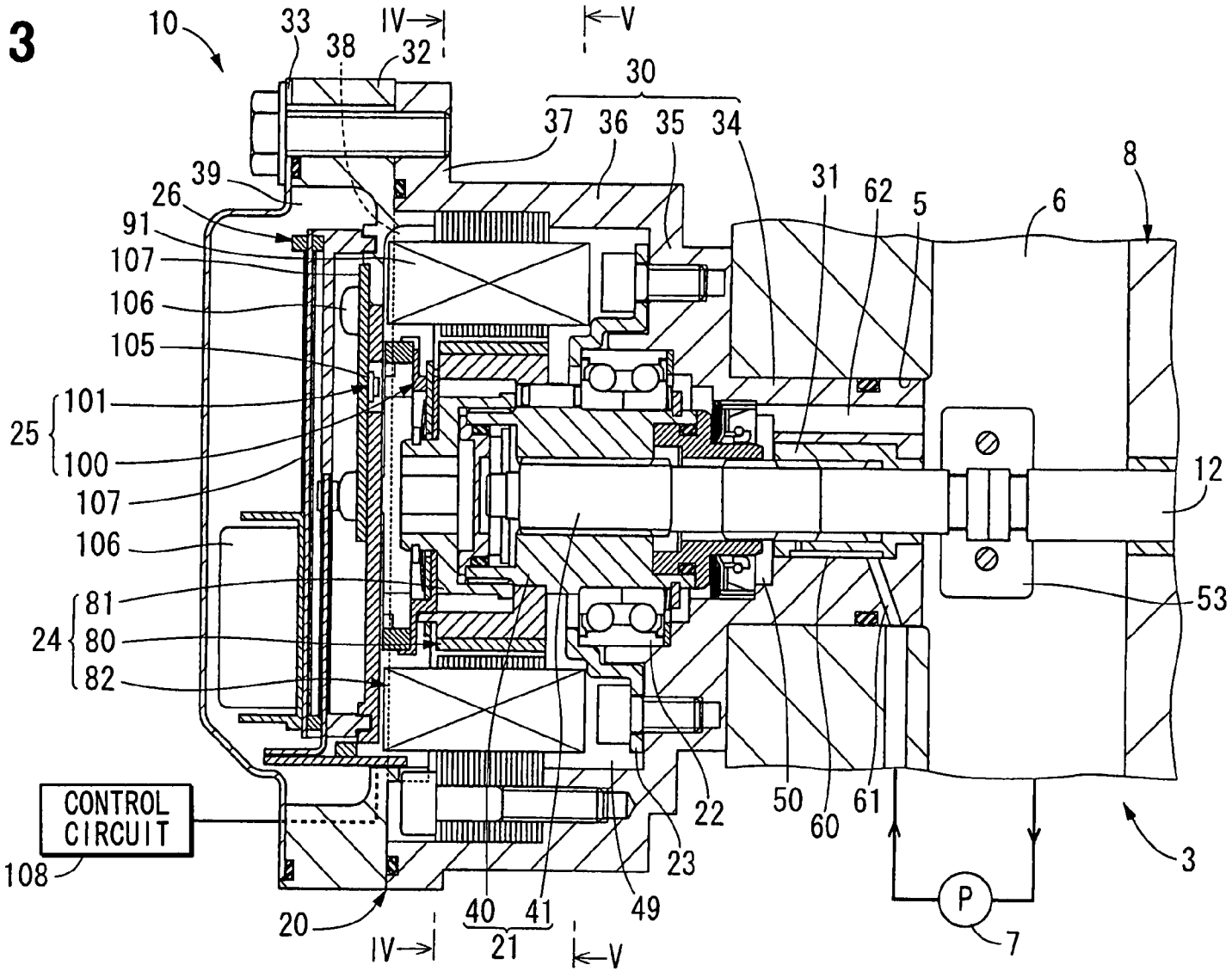
FIG. 3 is a cross-sectional view showing the actuator for the valve lift controller according to the first embodiment.

The actuator 10 moves the control shaft 12 in the axial direction. As shown in FIG. 3, the actuator 10 includes a case 20, a feed screw mechanism 21, a radial bearing 22, a restricting plate 23, a motor 24, a rotational angle sensor 25, and a driving circuit 26. The actuator 10 is installed in a vehicle so that the direction from the right to the left in FIG. 3 corresponds to a horizontal direction.

The case 20 includes a case body 30, a bush 31, a body cover 32, and a circuit cover 33. The case body 30 is cylindrically formed with steps, and includes a fitting portion 34, an engaging portion 35, a fixing portion 36, and a flange portion 37. The fitting portion 34 is inserted into a fitting hole 5 of the engine 3, whereby the position of the case body 30 is fixed relative to the engine 3. The bush 31 is cylindrically formed and is press-fitted into an inner wall of the fitting portion 34. The body cover 32 and the circuit cover 33 are cup-shaped and are fastened to the flange portion 37, whereby the body cover 32 covers an opening 38 of the case body 30 and defines a circuit chamber 39 in cooperation with the circuit cover 33.

The feed screw mechanism 21 is a trapezoidal screw mechanism in which the rotation spindle 40 engages with the screwed shaft 41, and is accommodated in the case body 30.

Figure 1:
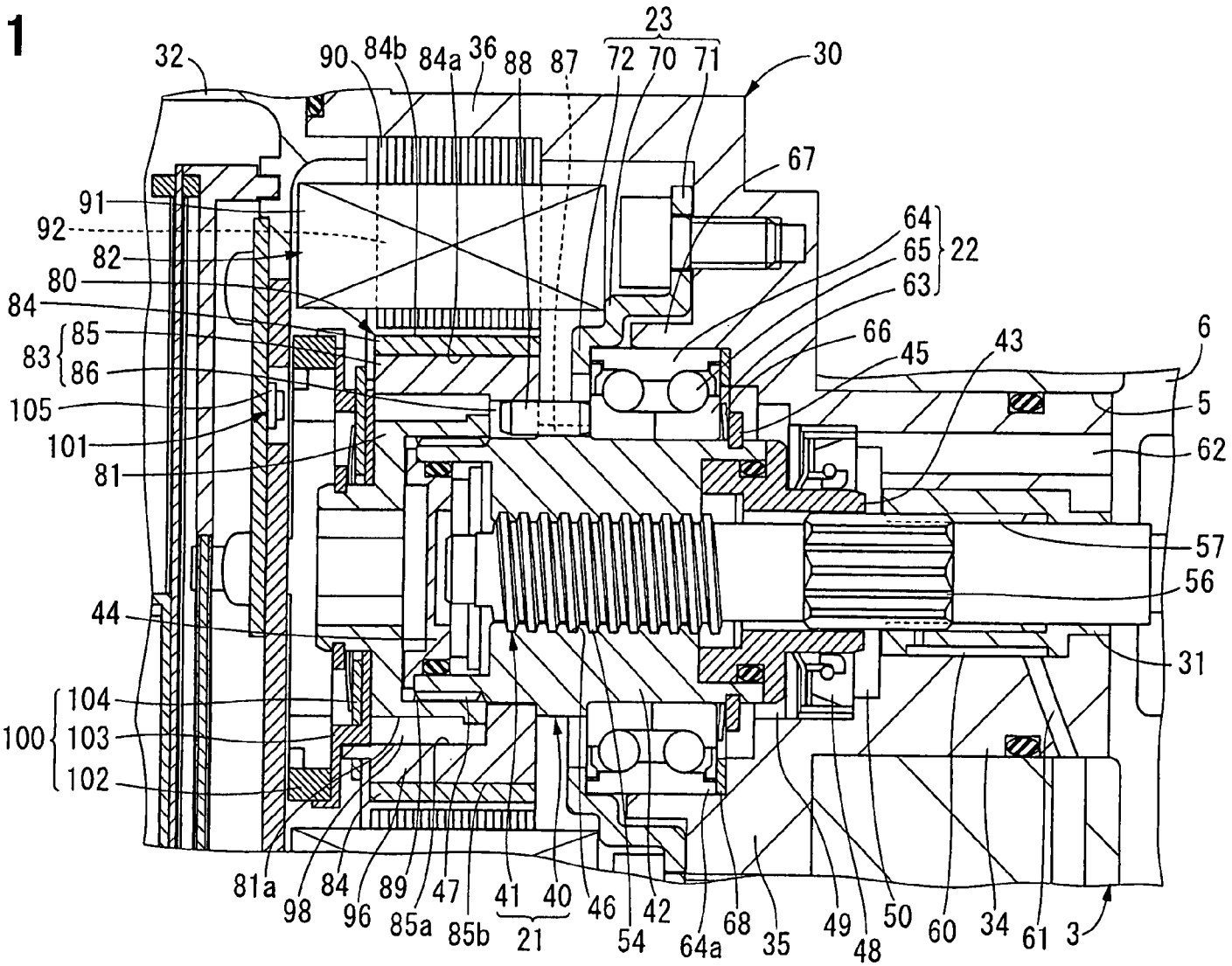
FIG. 1 is an enlarged cross-sectional view showing a main portion of an actuator for a valve lift controller according to a first embodiment of the present invention.

As shown in FIG. 1, the rotation spindle 40 includes a rotation sleeve 42, a seal sleeve 43, seal lid 44, and a circlip 45. The rotation sleeve 42 is cylindrically shaped and is arranged in the case body 30 coaxially. The rotation sleeve 42 is provided with an internal thread 46 of which cross-section is trapezoidal at an inner wall surface thereof. The rotation sleeve 42 is provided with an external thread 47 at outer wall surface of one end portion. The seal sleeve 43 is cylindrically formed to coaxially engage with the rotation sleeve 42 at the other end portion thereof. An oil seal 48 is provided between the seal sleeve 43 and the fitting portion 34, whereby a driving chamber 49 and an oil chamber 50 are defined in the case body 30. The seal lid 44 is a circular plate engaging with the rotation sleeve 42. The circlip 45 is C-shaped and engages with the outer wall surface of the rotation sleeve 42 in such a manner as not to move relatively in the axial direction thereof.

As shown in FIG. 3, the screwed shaft 41 is concentrically arranged with the rotation spindle 40. One end of the screwed shaft 41 is positioned in an oil passage 6 of the engine 3 to be connected with the control shaft 12 through a joint 53. The screwed shaft 41 reciprocates in an axial direction with the control shaft 12. As shown in FIG. 1, the screwed shaft 41 is provided with an external thread 54 of which cross-section is trapezoidal. This external thread 54 is engaged with the internal thread 46 of the rotation sleeve 42. A gap clearance is formed between the screwed shaft 41 and the seal sleeve 43 to permit a reciprocation of the screwed shaft 41. Splines 57, 57 are formed between an outer wall surface of the screwed shaft 41 and an inner wall surface of the bush 31, whereby the screwed shaft 41 reciprocates according as the rotation spindle 40 rotates in normal direction and reverse direction. The feed screw mechanism 21 converts a rotational movement of the rotation spindle 40 into the reciprocate movement of the screwed shaft 41.

A part of lubricant oil discharged from the oil pump 7 is introduced into the oil chamber 50 through oil passages 61, 60 and a clearance between the screwed shaft 41 and the bush 31. The lubricant oil in the oil chamber 50 flows into the rotation sleeve 42 to lubricate an engaging portion of the internal thread 46 and the external thread 54.

As shown in FIG. 1, the radial bearing 22 is a radial contact type ball bearing which includes an inner race 63, an outer race 64 and balls 65, and is accommodated in the driving chamber 49. The inner race 63 engages with the outer wall surface of the rotation sleeve 42. The circlip 45 engages with the inner race 63 via a plate spring 66. The outer race 64 engages with an inner wall surface of a cylindrical portion 67 of the engaging portion 35. One end 64*a* of the outer race 64 engages with the engaging portion 35 via a washer 68. The radial bearing 22 supports a radial force applied to the rotation spindle 40.

The restricting plate 23 includes a resilient portion 70, a screw-clamping portion 71, and an engaging portion 72. The resilient portion 70 is cylindrically formed and is arranged in such a manner as to be resiliently deformed in a situation where one portion engages with the outer wall surface of the outer race 64. The screw-clamping portion 71 is annularly formed to be fixed on the engaging portion 35 by a screw. The engaging portion 72 engages with the outer race 64. The engaging portion 72 biases the radial bearing 22 toward the engaging portion 35.

As shown in FIG. 3, the motor 24 is a brushless motor including a motor rotor 80, a rotor-fixing nut 81,and a motor stator 82.

Figure 4:
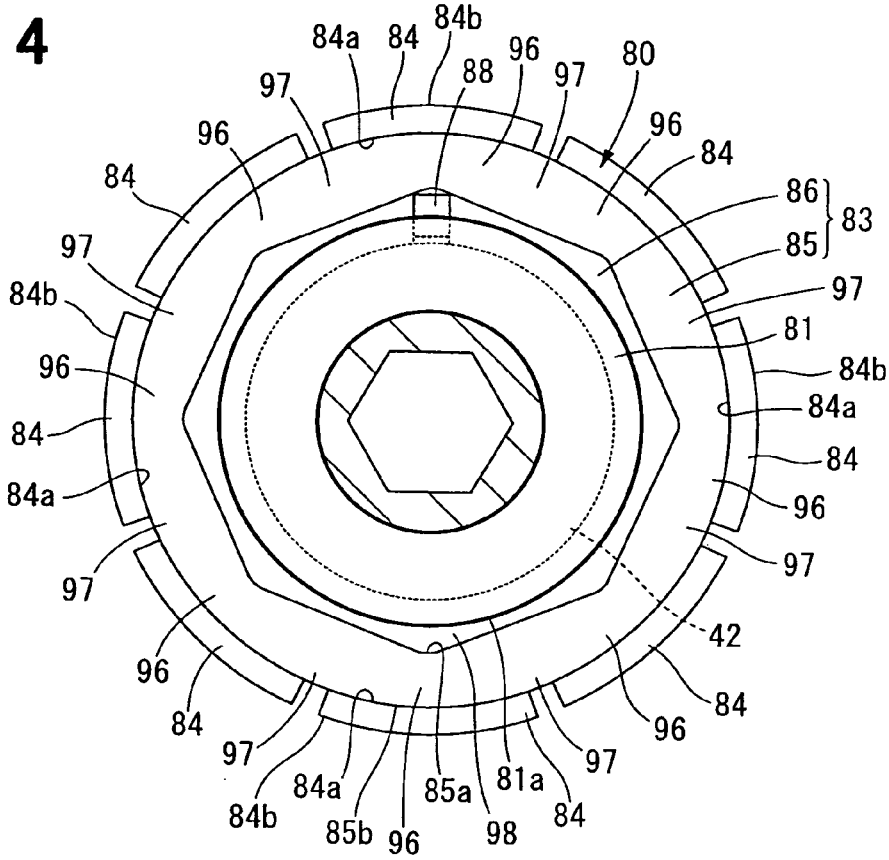
FIG. 4 is a cross-sectional view taken along a line IV-IV in FIG. 3.
Figure 5:
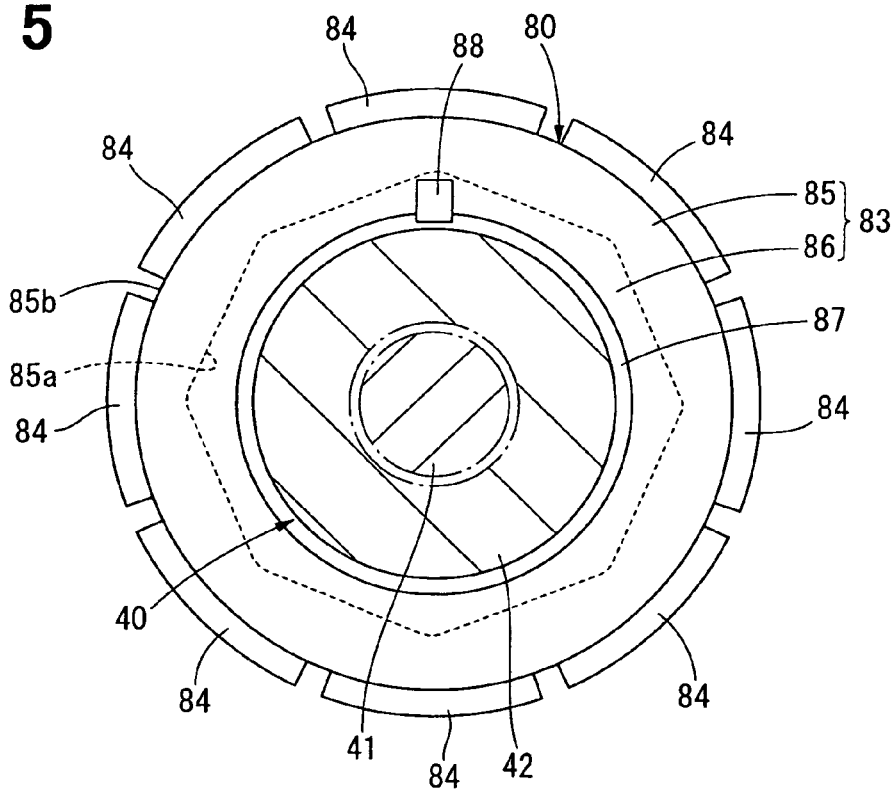
FIG. 5 is a cross-sectional view taken along a line V-V in FIG. 3.
Figure 6:
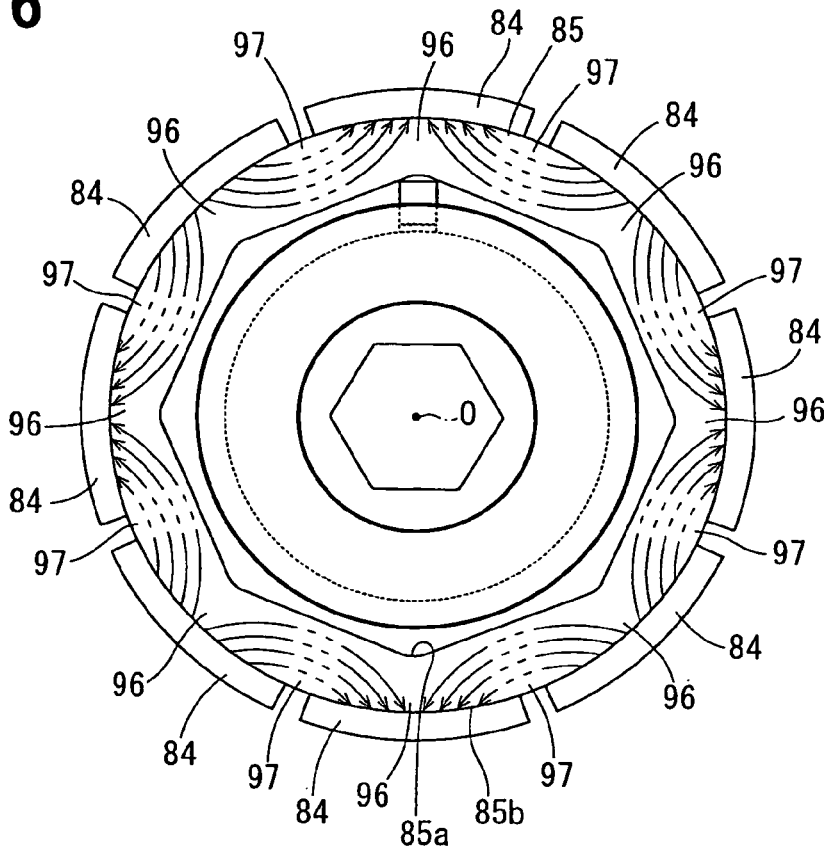
FIG. 6 is a schematic view for explaining a main portion of the actuator.
Figure 7:
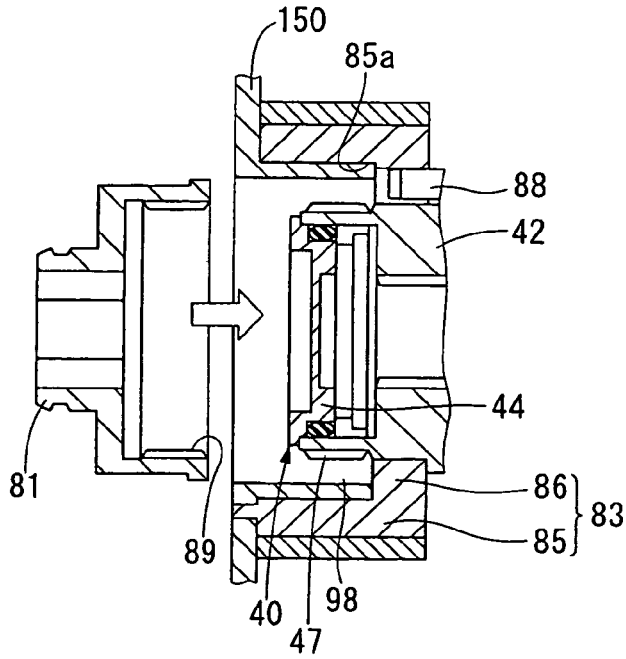
FIG. 7 is a longitudinal cross-sectional view for explaining a manufacturing method of the actuator according to the first embodiment.

As shown in FIGS. 1, 4, and 5, the motor rotor 80 includes a rotor core 83 and rotor magnets 84. The rotor core 83 is provided with a core protrusion 86 which projects inwardly to engage with the outer surface of the rotation sleeve 42. An annular sleeve protrusion 87 of the rotation sleeve 42 engages with the core protrusion 86 with a positioning key 88. The rotor magnet 84 is an arc-shaped permanent magnet, which are provided on the outer wall surface of the core body 85 at regular intervals, whereby the core body 85 interchangeably has a magnet portion 96 on which the magnet 84 is provided and a non-magnet portion 97 on which no magnet is provided. Each rotor magnet 84 generates polar character which is opposite character of adjacent rotor magnets 84 at the inner wall surface 84*a* of the core body 85. Opposite polar character is generated on the outer wall surface 84*b* of the core body 85. Magnetic flux is generated as shown by double-dashed lines in FIG. 6. This magnetic flux is referred to as a core-passing magnetic flux, hereinafter.

A cross-section of the inner wall surface 85*a* of the core body 85 is octagon, and a cross-section of the outer wall surface 85*b* of the core body 85 is a substantially coaxial circle in order to increase the core-passing magnetic flux. Hence, the non-magnet portion 97 is thicker than the magnet portion 96.

As shown in FIG. 1, the cup-shaped rotor-fixing nut 81 has an internal thread 89. The internal thread 89 engages with the external thread of the rotation sleeve 42, whereby the core protrusion 86 is connected with the rotation spindle 40 by being sandwiched between the rotor-fixing nut 81 and the sleeve protrusion 87. The rotation spindle 40 functions as a motor shaft of the motor rotor 80. A cylindrical space 98 is defined between an outer wall surface 81*a* of the rotor-fixing nut 81 and the inner wall surface 85*a* of the core body 85.

The motor stator 82 includes a stator core 90 and a stator coil 91. The stator core 90 is annularly formed substantially on the same axis of the motor rotor 80. The stator core 90 engages with the inner wall surface of the fixing portion 36 with a screw (not shown). Multiple slots 92 are formed at inner wall surface of the stator core 90. A stator coil is wound in the slots 92 through a stator bobbin (not shown).

As shown in FIG. 3, the rotational angle sensor 25 is a non-contacting type sensor including a magnetic portion 100 and a sensing portion 101. The magnetic portion 100 includes a sensor magnet 102, magnet holder 103 and a positioning plate 104, and is accommodated in the driving chamber 49. The sensor magnet 102 is an annular permanent magnet which generates magnetic pole at multiple positions in a circumferential direction. The magnet holder 103 engages with a bottom of the rotor-fixing nut 81 to hold the sensor magnet 102 substantially coaxially with respect to the rotation spindle. The positioning plate 104 engages with the magnet holder 103 to position the sensor magnet 102 is a circumferential direction.

Hall effect elements 105 comprising the sensing portion 101 are disposed in a circumferential direction of the rotation spindle 40 at regular intervals. Each Hall effect element 105 confronts the magnetic portion 100 to detect rotational angle of the rotation spindle 40 by sensing a magnetic field generated by the sensor magnet 102.

A driving circuit 26 includes multiple base plates 107 on which a circuit element 106 is implemented. The driving circuit 26 is held by the body cover 32 in such a manner as to be accommodated in the circuit chamber 39. The driving circuit 26 is electrically connected with the stator coils 91, the Hall effect elements 105, and a control circuit 108. The control circuit mainly includes a microcomputer. The control circuit 108, which receives outputs from the Hall effect elements 105 through the driving circuit 26, determines the rotational angle of the rotation spindle 40 and an axial direction of the control shaft 12 in order to estimate the actual valve lift amount based on the axial position of the control shaft 12. The control circuit 108 sends a command signal to the driving circuit 26 in order to reduce the difference between the actual valve lift amount and the target valve lift amount. Receiving a command signal from the control circuit 108, the driving circuit 26 controls a current supply to the stator coil 91 to generate rotating magnetic field around the motor rotor 80. This rotating magnetic field rotates the motor rotor 80 with the rotation spindle 40, whereby the screwed shaft 41 and the control shaft 12 reciprocate in the axial direction thereof to obtain the target valve lift amount. The target valve lift amount represents a physical amount which is determined based on the engine speed, an accelerator position, and the like.

As described above, according to the first embodiment, the core protrusion 86 is sandwiched between the sleeve protrusion 87 and the rotor-fixing nut 81. Thereby, even if the rotor core 83 is engaged with the rotation sleeve 42 with small force, the motor rotor 80 is mechanically fixed in the axial direction thereof with respect to the rotation spindle 40. Furthermore, the annular sleeve protrusion 87 is formed around the rotation spindle 40, so that an accuracy of positioning the motor rotor 80 in the axial direction is improved. Besides, the positioning key 88 is engaged with the core protrusion 86 and the sleeve protrusion 87, so that the motor rotor 80 is firmly fixed in the circumferential direction with respect to the rotation spindle 40.

When the actuator 10 is manufactured, the core body 85 engaging with the rotation sleeve 42 is supported by a jig 150 which is inserted in to the cylindrical space 98, and then the rotor-fixing nut 81 is threaded into the rotation sleeve 42 to fix the motor rotor 80 on the rotation spindle 40. Hence, the motor rotor is easily fixed on the rotation spindle 40 without additional force, so that the deformation of the rotation spindle 40 is well restricted.

Furthermore, since the non-magnet portion 97 is thicker than the magnet portion 96, the core-passing magnetic flux is increased. This increment effect of the core-passing magnetic flux can be obtained equally in the circumferential direction. The rotational operation of the motor rotor 80 is improved.

Besides, since the non-magnet portion 97 is thicker than the magnet portion 96, and the cylindrical space 98 is defined along the inner wall surface 85*a*, the magnet portion 96 can be made thin. Hence, the rotor core 83 is made lighter to reduce an inertial force applied to the motor rotor 80 and the rotation spindle 40, so that an initial responsiveness of the feed screw mechanism can be enhanced.

Second Embodiment

Figure 8:
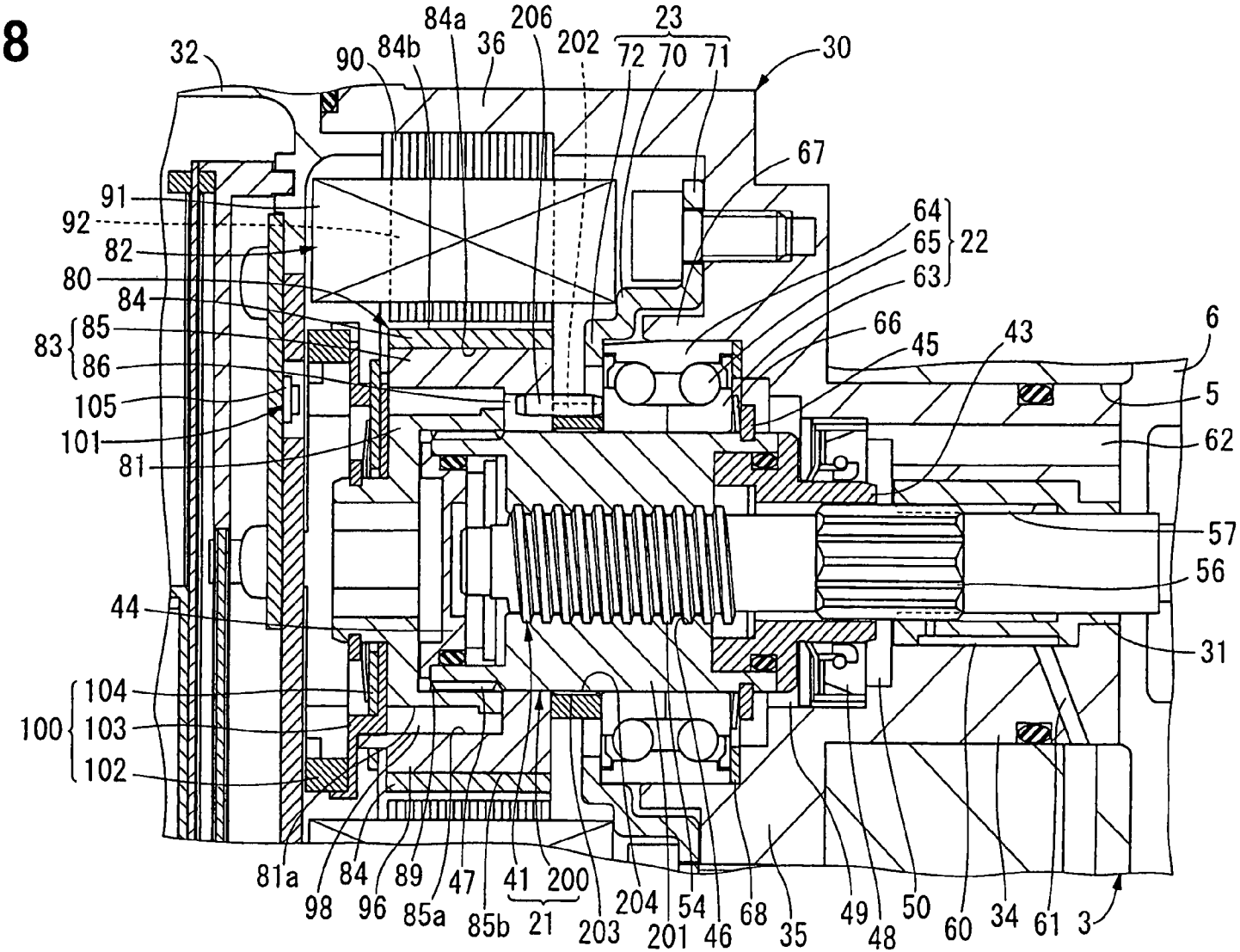
FIG. 8 is an enlarged cross-sectional view showing a main portion of an actuator for a valve lift controller according to a second embodiment of the present invention.

A second embodiment shown in FIG. 8 is a modification of the first embodiment. The same parts and components as those in the first embodiment are indicated with the same reference numerals and the same descriptions will not be reiterated.

A rotation spindle 200 has a rotation sleeve 201 on which a second rotor-fixing nut 202 is threaded. Specifically, an external thread 203 is provided on an outer wall surface of the rotation sleeve 201. The second cylindrical rotor-fixing nut 202 is provided with an internal thread 204 which engages with the external thread 203. The core protrusion 86 is sandwiched between the first rotor-fixing nut 81 and the second rotor-fixing nut 202 to be fixed on the rotation spindle 200. A positioning key 206 engages with the core protrusion 86 and the second rotor-fixing nut 202.

According to the second embodiment, since the motor rotor 80 is mechanically fixed on the rotation spindle 200 by threading the first rotor-fixing nut 81 and the second rotor-fixing nut 202 into the rotation sleeve 201, a deformation of the rotation spindle 200 is restricted to avoid an operation failure of the feed screw mechanism 21.

Third Embodiment

Figure 9:
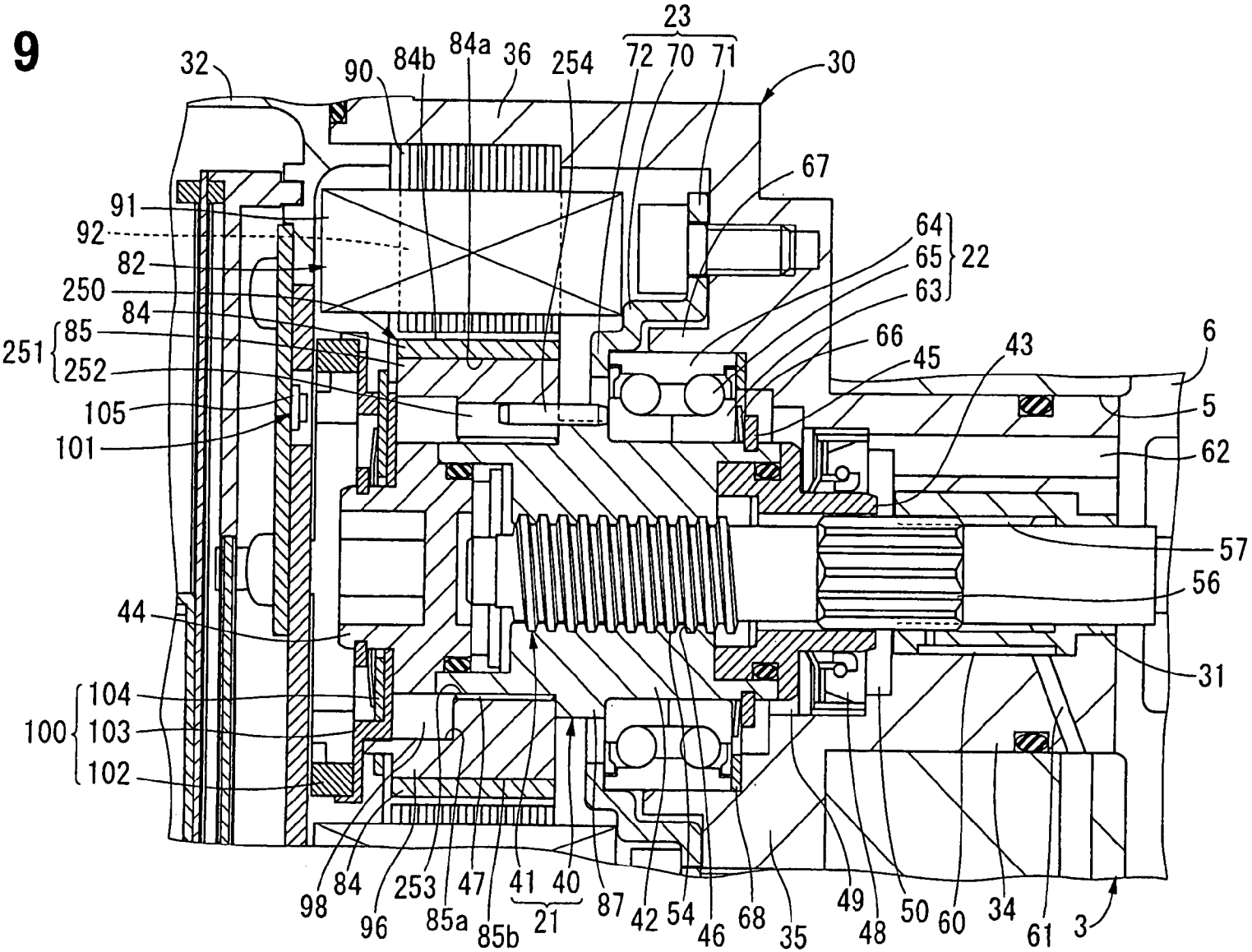
FIG. 9 is an enlarged cross-sectional view showing a main portion of an actuator for a valve lift controller according to a third embodiment of the present invention.

A third embodiment shown in FIG. 9 is a modification of the first embodiment. The same parts and components as those in the first embodiment are indicated with the same reference numerals and the same descriptions will not be reiterated.

In the third embodiment, a core protrusion 252 of the rotor core 251 is directly threaded on the rotation sleeve 42. Specifically, the core protrusion 252 is provided with an internal thread 253. The sleeve protrusion 87 of the rotation sleeve 42 engages with the core protrusion 252 with the internal thread 253 threaded with the external thread 47 of the rotation sleeve 42. Hence, the core protrusion 252 is fixed on the rotation spindle 40 by engaging with the sleeve protrusion 87 and the external thread 47. A positioning key 254 engages with the core protrusion 252 and the sleeve protrusion 87.

According to the third embodiment, since the motor rotor 250 is mechanically fixed on the rotation spindle 40 by threading the rotor core 251 on the rotation sleeve 42, a deformation of the rotation spindle 40 is restricted to avoid an operation failure of the feed screw mechanism 21.

In the third embodiment, the seal lid 44 is cup-shaped to define a space 98 between outer wall surfaces of the seal lid 44 and the rotation sleeve 42 and an inner wall surface 85*a* of the core body 85. A magnet holder 103 and a positioning plate 104 are engaged with a bottom of the seal lid 44.

(Modifications)

In the first to third embodiments, the motor rotor 80, 250 can be fixed on the rotation spindle 40, 200 with an adhesive agent in addition to the thread engagement of the rotor-fixing nut 81, 202 or the rotor core 251. The positioning key 88, 206, 254 can b taken out. Especially, in the third embodiment, in the case that the positioning key 254 is not provided, the sleeve protrusion 87 can be removed. The cross-section of the inner wall surface 85*a* of the core body 85 and the cross-section of the outer wall surface 85*b* of the core body 85 can be changed into different shapes. It is preferable that the cross-section of the inner wall surface 85*a* is a regular polygon of which number of edges is equal to the number of the rotor magnets 84. Alternatively, the cross-section of the inner wall surface 85*a* and the outer wall surface 85*b* can be made concentric circles.

The sleeve protrusion 87 can be made C-shaped, or can be divided multiple arc-shaped portions. The core protrusion 86 can be made C-shaped, or can be divided multiple arc-shaped portions. In the third embodiment, the inner wall surface of the core body 85 can be directly threaded on the outer wall surface of the rotation sleeve 42 without defining the space 98.

The feed screw mechanism 21 can be made in such a manner that the rotation spindle 40, 200 is connected with the screwed shaft 41 via gears or balls. The control shaft 12 can be eccentrically connected with the screwed shaft 41.

The motor 24 can be a DC motor as well as the brushless motor. The rotor magnets 84 can be embedded in the rotor core 83. The control circuit 108 can be disposed in the case 20 with the driving circuit 26. The sensing portion 101 can be comprised of a magnetoresistive effect element. The changing mechanism 8 can change a lift amount of an exhaust valve of an internal combustion engine 3. The changing mechanism 8 can bias the screwed shaft toward the actuator 10 by a valve reaction force transmitted to the control shaft.

What is claimed is:

1. An actuator for a valve lift controller controlling a lift amount of an intake valve and/or an exhaust valve, the actuator linearly driving a control shaft to change the lift amount according to an axial position of the control shaft, comprising:

a feed screw mechanism including a screwed shaft which moves linearly along with the control shaft, and a rotation spindle which rotates in a circumferential direction, the feed screw mechanism converting a rotational movement of the rotation spindle into a linear movement of the screwed shaft;

a protrusion protruding outwardly from the rotation spindle;

an internal thread member engaging with an outer wall surface of the rotation spindle;

a motor stator generating a magnetic field when energized; and a motor rotor positioning over the rotation spindle, the motor rotor sandwiched between the protrusion and the internal thread member in an axial direction of the rotation spindle, the motor rotor rotating along with the rotation spindle in the magnetic field generated by the motor stator, the motor rotor includes a cylindrical rotor core and a plurality of rotor magnets disposed in a circumferential direction of the rotor core, wherein the rotor magnets are disposed on an outer wall surface of the rotor core, and each rotor magnet generate a magnetic pole which is alternately reverse between adjacent rotor magnets the rotor core includes non-magnet portions on which no magnet is disposed and magnet portions on which magnets are disposed, the non-magnet portions are thicker than the magnet portions, and the rotor core includes an outer wall surface of which cross section is circle, and an inner wall surface which concaves toward the outer wall surface along a circumferential direction from a center portion of the non-magnet portions to a center portion of the magnet portion.

2. An actuator for a valve lift controller according to claim 1, wherein the protrusion is formed on entire surface of the rotation spindle in a circumferential direction thereof.

3. An actuator for a valve lift controller according to claim 1, further comprising an engaging member engaging with the protrusion and the motor rotor in such a manner as to penetrate a contacting surface between the protrusion and the motor rotor.

4. An actuator for a valve lift controller according to claim 1, wherein the motor rotor defines a space along an inner wall surface thereof.

5. An actuator for a valve lift controller according to claim 1, wherein the rotor magnets are arranged in a circumferential direction of the rotor core, and the rotor core includes an inner wall surface of which cross section is a regular polygon.

6. An actuator for a valve lift controller controlling a lift amount of an intake valve and/or an exhaust valve, the actuator linearly driving a control shaft to change the lift amount according to an axial position of the control shaft, comprising:

a feed screw mechanism including a screwed shaft which moves linearly along with the control shaft, and a rotation spindle which rotates in a circumferential direction, the feed screw mechanism converting a rotational movement of the rotation spindle into a linear movement of the screwed shaft;

a first internal thread member and a second internal thread member respectively engaging with an outer wall surface of the rotation spindle;

a motor stator generating a magnetic field when energized; and a motor rotor positioning over the rotation spindle, the motor rotor sandwiched between the first internal thread member and the second internal thread member, the motor rotor rotating along with the rotation spindle in the magnetic field generated by the motor stator, wherein the motor rotor includes a cylindrical rotor core and a plurality of rotor magnets disposed in a circumferential direction of the rotor core, the rotor magnets are disposed on an outer wall surface of the rotor core, and each rotor magnet generate a magnetic pole which is alternately reverse between adjacent rotor magnets the rotor core includes non-magnet portions on which no magnet is disposed and magnet portions on which magnets are disposed, the non-magnet portions are thicker than the magnet portions, and the rotor core includes an outer wall surface of which cross section is circle, and an inner wall surface which concaves toward the outer wall surface along a circumferential direction from a center portion of the non-magnet portions to a center portion of the magnet portion.

7. An actuator for a valve lift controller according to claim 6, further comprising an engaging member engaging with the first internal thread member and the motor rotor in such a manner as to penetrate a contacting surface between the first internal thread member and the motor rotor.

8. An actuator for a valve lift controller according to claim 6, wherein the rotor magnets are arranged in a circumferential direction of the rotor core, and the rotor core includes an inner wall surface of which cross section is a regular polygon.

9. An actuator for a valve lift controller controlling a lift amount of an intake valve and/or an exhaust valve, the actuator linearly driving a control shaft to change the lift amount according to an axial position of the control shaft, comprising:

a feed screw mechanism including a screwed shaft which moves linearly along with the control shaft, and a rotation spindle which rotates in a circumferential direction, the feed screw mechanism converting a rotational movement of the rotation spindle into a linear movement of the screwed shaft;

a motor stator generating a magnetic field when energized; and a motor rotor threaded on an outer wall surface of the rotation spindle, the motor rotor rotating along with the rotation spindle in the magnetic field generated by the motor stator, wherein the motor rotor includes a cylindrical rotor core and a plurality of rotor magnets disposed in a circumferential direction of the rotor core, the rotor magnets are disposed on an outer wall surface of the rotor core, and each rotor magnet generate a magnetic pole which is alternately reverse between adjacent rotor magnets the rotor core includes non-magnet portions on which no magnet is disposed and magnet portions on which magnets are disposed, the non-magnet portions are thicker than the magnet portions, and the rotor core includes an outer wall surface of which cross section is circle, and an inner wall surface which concaves toward the outer wall surface along a circumferential direction from a center portion of the non-magnet portions to a center portion of the magnet portion.

10. An actuator for a valve lift controller according to claim 9, further comprising:

a protrusion protruding outwardly from the rotation spindle and engaging with one end portion of the motor rotor, and an engaging member engaging with the protrusion and the motor rotor in such a manner as to penetrate a contacting surface between the protrusion and the motor rotor.

11. An actuator for a valve lift controller according to claim 9, wherein the rotor magnets are arranged in a circumferential direction of the rotor core, and the rotor core includes an inner wall surface of which cross section is a regular polygon.

* * * * *